US005943725A

United States Patent [19]

Wandres

[11] Patent Number: 5,943,725

[45] Date of Patent: Aug. 31, 1999

[54] APPARATUS FOR CLEANING SURFACES WITH A CLEANING STRAND

[75] Inventor: Claus G. Wandres, Stegen, Germany

[73] Assignee: Wandres GmbH Micro - Cleaning, Buchenbach-Wagensteig, Germany

[21] Appl. No.: 08/856,843

[22] Filed: May 15, 1997

[30] Foreign Application Priority Data

Jun. 21, 1996 [DE] Germany ..... 196 24 902

[51] Int. Cl.[6] ..... B08B 1/04

[52] U.S. Cl. ..... 15/77; 15/99; 15/102

[58] Field of Search ..... 15/99, 88.2, 77, 15/102, 80, 34, 51, 22.3, 53.1, 49.1; 474/92, 139, 148, 205

[56] References Cited

U.S. PATENT DOCUMENTS

| | | | |
|---|---|---|---|
| 709,562 | 9/1902 | Swan et al. | 15/88.2 |
| 793,234 | 6/1905 | Scanlan | 15/22.3 |
| 2,724,974 | 11/1955 | Ayres | 474/205 |
| 2,838,946 | 6/1958 | Kiekhaefer | 474/205 |
| 3,026,737 | 3/1962 | Berg | 474/205 |
| 3,129,535 | 4/1964 | Slottery | 15/102 |
| 3,252,175 | 5/1966 | Pedersen | 15/22.3 |
| 3,540,301 | 11/1970 | Bartz | 474/205 |
| 3,686,699 | 8/1972 | Knestele | 15/22.3 |

FOREIGN PATENT DOCUMENTS

| | | | |
|---|---|---|---|
| 85 25 160 U | 12/1985 | Germany . | |
| 42 13 342 A1 | 10/1993 | Germany . | |
| 1041007 | 9/1966 | United Kingdom | 15/77 |

*Primary Examiner*—Gary K. Graham

*Attorney, Agent, or Firm*—Panitch Schwarze Jacobs & Nadel, P.C.

[57] ABSTRACT

An apparatus (1) serves for cleaning surfaces on boards, for instance, and has a cleaning device (2) which is circumferentially continuous and has an upper strand (2) and a lower strand (4) and two guide pulleys (5, 6) in between. The one strand is the cleaning strand which is held by a guide (8) and is pressed onto the surface to be cleaned. A carrier belt (7) is recessed or flattened in some regions of at least one longitudinal side and is therefore narrower in relation to the rest of its longitudinal area. At least one part (8*a*) at the entrance end of the guide (8) as considered in the feed direction of the cleaning strand, is deflectable or flexible outwardly from the feed direction and can thereby be applied to the inside (7*a*) of the carrier belt (7). The guide (8) has a substantially C-shaped cross section accommodating the entire width of the carrier belt (7). A narrower slot (10) of the guide (8) has a width smaller than that of the carrier belt (7), but equal to or greater than the recessed or flattened area of the carrier belt (7), so that when the part (8*a*) is deflected this recessed area of the carrier belt (7) enters the guide (8) and the following wider area of the carrier belt (7) is threaded into the guide.

7 Claims, 4 Drawing Sheets

APPARATUS FOR CLEANING SURFACES WITH A CLEANING STRAND

BACKGROUND OF THE INVENTION

The invention relates to an apparatus for cleaning surfaces, particularly on boards, sheets or laminates made of plastic for example, comprising a cleaning device having an upper strand and a lower strand as well as at least two guide pulleys or guide rollers. The cleaning device has the one strand acting as the cleaning strand applied to the surface to be cleaned and at the inner surface facing the guide pulleys or guide rollers said cleaning device is fastened to a supple carrier band or carrier belt capable of withstanding tensile stresses. The apparatus has a press-on device with a guide for the cleaning strand, by means of which the cleaning strand can be pressed onto the surface to be cleaned during the feed movement of the strand through the guide.

An apparatus of this character is known by way of example from DE-42 13 342 A1. Column 1, lines 11 to 14, describes such a cleaning device having bristles on its upper strand and lower strand, producing a continuous brush.

There is a certain problem with such apparatuses and cleaning devices if the cleaning device itself, i.e., the bristles in the specified example, are worn and therefore the cleaning device has to be replaced. In the case of the apparatuses known hitherto, the guides are of divided construction so as to permit the fitting of several uniform belts with bristles in side by side relation and so as to enable the replacement of such belts with bristles or comparable cleaning devices, as are also described in DE-42 13 342. By this means it can be achieved that the guide holds them securely and well and engages over at least part of their area, but nevertheless they can be placed in and removed from the guide by taking it apart. Apart from the elaborate assembly and the complexity of divided guides, a large amount of space is required for such divided guides due to the necessary fasteners.

SUMMARY OF THE INVENTION

An object underlying the invention is therefore to provide an apparatus of the kind stated at the outset, with which the space required for the guides is reduced and nevertheless the cleaning device(s), despite their endless form, can be introduced in a simple fashion into the guides overlapping them.

To accomplish this seemingly contradictory objective, the apparatus specified at the outset is characterized in that the carrier belt is recessed or flattened in some regions of at least one longitudinal side and is therefore narrower in relation to the rest of its longitudinal area, that at least one part near the entrance of the guide, as considered in the feed direction of the cleaning strand, is deflectable or flexible radially outwardly from the feed direction and is thus applied to the inside of the carrier belt, and that the guide has a substantially C-shaped cross section accommodating the entire width of the carrier belt, whereby the narrower slot of the profiled slot has a width smaller than that of the carrier belt, but equal to or greater than the recessed or flattened area of the carrier belt.

In this manner it is possible to dispense with a division of the guide for inserting the carrier belt, although the carrier belt is circumferentially continuous. The carrier belt can simply be placed externally over the guide pulleys and the guide. When the part near the entrance of the guide, as considered in the feed direction of the cleaning strand, is deflected outwardly and is thus applied to the inside of the carrier belt, the latter then slips into the guide when its recessed or flattened area reaches the beginning of the guide.

By virtue of the deflectable guide and by virtue of the carrier belt being suitably recessed in some regions, the carrier belt can in practice be threaded automatically. The deflectable end of the guide is situated near one of the guide pulleys, so that additionally an inwardly directed force component on the carrier band presses the same into the beginning of the guide, as soon as the narrower dimension of the carrier belt so permits. The following, wider part of the carrier belt is then encompassed by the guide in the usual way. Once the narrower area has been moved throughout the guide, the carrier belt as a whole is threaded and the deflection of the guide can be reversed either shortly beforehand or then at the latest.

The cleaning device can preferably be a linear brush with a carrier belt presenting the bristles, whereby the width of the carrier belt is greater than that of the array of bristles, and in the position of use at least one bristle free edge of the carrier belt is overlapped by the guide of C-shaped contour. Hence it may suffice if the C-shape and the overlapping concerns only one edge of the carrier belt. This overlapped edge area is then to be provided with the recess or flattening so that, during threading, the area of the carrier belt adjoining its recessed location can engage under this area of the guide.

As a result of the guide and carrier belt or carrier band being configured according to the invention, a division of the guide in its longitudinal direction becomes superfluous, allowing it to be more compact in design.

For good guidance and threading it is particularly suitable if the carrier belt is overlapped by the profile of the guide at both longitudinal edges and in the narrower area is recessed or flattened at both sides. This produces a symmetrical guide with correspondingly secure retention of the cleaning device during its operation, and nevertheless permits a new cleaning band of this kind to be threaded easily after the old one has been removed. For removing the carrier band, it is possible for instance to simply cut it, if it is no longer of any use due to wear.

The carrier belt can be a flat belt or a V-belt and is possibly a toothed belt. A V-belt is advantageous particularly because it can be drawn by appropriate guide pulleys with sufficiently great force through the guide, inside which it is also subject to a friction force by pressing onto the surface to be cleaned. With a toothed belt the drive can be transferred even better to the revolving carrier belt. In the case of a V-belt, the flattening can be selected in such a way that in the flattened or recessed area, the width present at the inside of this V-belt is then also present at the outside, hence the V-flanks are removed in this area.

Mention was already made that the deflectable or flexible part of the guide can be arranged near the guide pulley from which the carrier band or carrier belt enters the guide. This facilitates the above-described threading operation, which can be automated in that a working cylinder or a lever that engages or is mounted between the upper strand and the lower strand is applied to the deflectable or flexible or swingable part of the guide. To be sure, manual operation would also be possible, but preference is to be given to the remote control and automation to avoid the necessity of manipulation between upper strand and lower strand.

As a result of the invention a further development of considerable advantage is possible, permitting the carrier belt to be removed from the guide in a manner analogous to that in which it can be threaded into it. This development of the invention may consist in that the guide or profiled guide is devised so as to be movable or swingable away from the cleaning strand, so that the part of the carrier band or carrier belt that follows its narrower location runs out of the guide when the latter is in an inwardly moved condition. Since the carrier belt has a tension, an inward movement of the guide leads to the overlapped part of the belt bearing with greater force against the respective webs of the profile. As soon as the narrower area of the belt reaches the beginning of the guide, the belt is hence deflected radially outwardly relative to the guide, so that the following part no longer runs into the guide, and is thus "unthreaded".

An important part of the apparatus according to the invention is hence the cleaning device with a carrier band or carrier belt that revolves over at least two guide pulleys or guide rollers and can be used in the apparatus specified at the outset. It is important for accomplishing the objective that the carrier band or carrier belt has at least one recess or relief on one side or two mutually opposed recesses at the longitudinal narrow sides and is narrower in the region of the recess than in the following area. The carrier band or carrier belt can be wider than the array of bristles it bears and in the direction crosswise to the expanse of the belt or band the lateral recess(es) can have a dimension that is equal to or smaller than the width of the bristle-free edge area. A thus configured carrier belt of a cleaning device can be used in an apparatus defined at the outset and on the basis of the recesses at the longitudinal narrow sides can be threaded well into lengthwise extending guides, whereby only some deflection at the entrance of the guide is required for the initially narrower area to be aligned with the longitudinal direction of the guide, so that the adjoining wider area then automatically slips into the guide and is threaded.

The transition from the greatest width of the band or belt to the narrowest point can be rounded or beveled in the region of the recess, so as to facilitate particularly the threading process, but possibly also unthreading.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings in schematic form.

DETAILED DESCRIPTION OF THE INVENTION

An apparatus, generally designated 1, serves for cleaning surfaces which may be the upper sides or undersides of boards, sheets or the like. In the exemplary embodiment depicted in FIG. 1, the apparatus 1 is arranged in such a manner as to be able to clean a surface situated underneath it. In the same way, however, the apparatus 1 can be used turned 180° for cleaning the underside of a board or the like.

Figure 1:
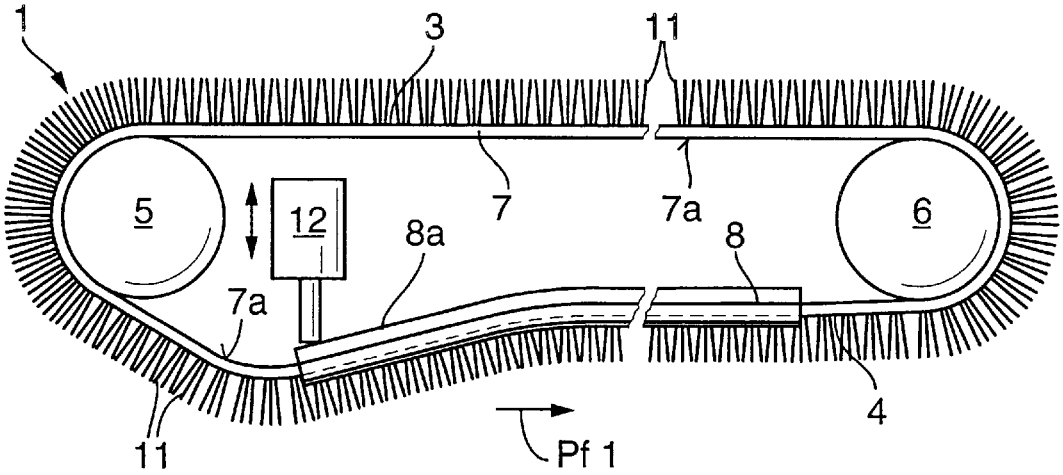
FIG. 1 is a side view of an apparatus according to the invention, comprising a cleaning device bearing bristles which revolves around two guide rollers and is held in the region of the surface to be cleaned by a guide adapted to be deflected outwardly at its entrance, wherein the apparatus is depicted in interrupted form for reasons of space, and the entrance area of the guide is shown in a deflected condition.

The apparatus 1 has a looped cleaning device in the form of a belt or band, generally designated 2, which has an upper portion 3, a lower portion 4 and two guide pulleys 5 and 6, whereby one strand, in FIG. 1 the lower portion 4, serves as the cleaning device and is applied to the surface to be cleaned. In FIG. 1 the latter is not shown for the sake of simplicity.

At its inside facing the guide pulleys 5 and 6, which may also be rollers, this cleaning device is attached to a supple carrier band or carrier belt 7 capable of withstanding tensile stresses, or this carrier belt 7 is an essential part of the circumferentially continuous cleaning device.

The apparatus 1 has a press-on device 12 with an elongated guide 8 for the cleaning strand running through this guide 8. The cleaning device is pressable by the press-on device 12 onto the surface to be cleaned in the feed direction according to arrow Pf 1 by means of the guide 8. This pressure can be preset at will and according to need. In the exemplary embodiment, the direction of feed according to arrow Pf 1 is from left to right.

Further Figures indicate the reverse arrangement in which an underside is cleaned.

Particularly FIGS. 2 to 6 show that on at least one longitudinal side, in the exemplary embodiment at both mutually opposed longitudinal sides, the carrier belt 7 belonging to the cleaning device 2 is recessed or relieved in some regions and is hence narrower in relation to the rest of its longitudinal area. These recesses 9 exactly opposite each other can be clearly seen particularly in FIG. 2.

According to FIG. 1, a part 8*a* at the entrance end of the guide 8, as considered in the feed direction of the cleaning strand, is deflectable or swingable or flexible so as to depart outwardly from the direction of feed and, in so doing, is applied to the inside 7*a* of the carrier belt 7, as is illustrated in FIG. 1. The outward deflection takes place to the effect that in this deflected area the lower strand 4 becomes spaced further from the upper strand 3 than in the other areas.

According to FIGS. 3 to 6, the guide has a substantially C-shaped cross section capable of accommodating the entire width of the carrier belt 7. The narrower slit 10—through which according to FIG. 3 the bristles situated on the carrier belt 7 can project from the profiled guide—has a width smaller than that of the carrier belt 7 but equal to or greater than the relieved or flattened area of the carrier belt 7. This becomes clear particularly by reference to FIGS. 3 and 4.

Figure 5:
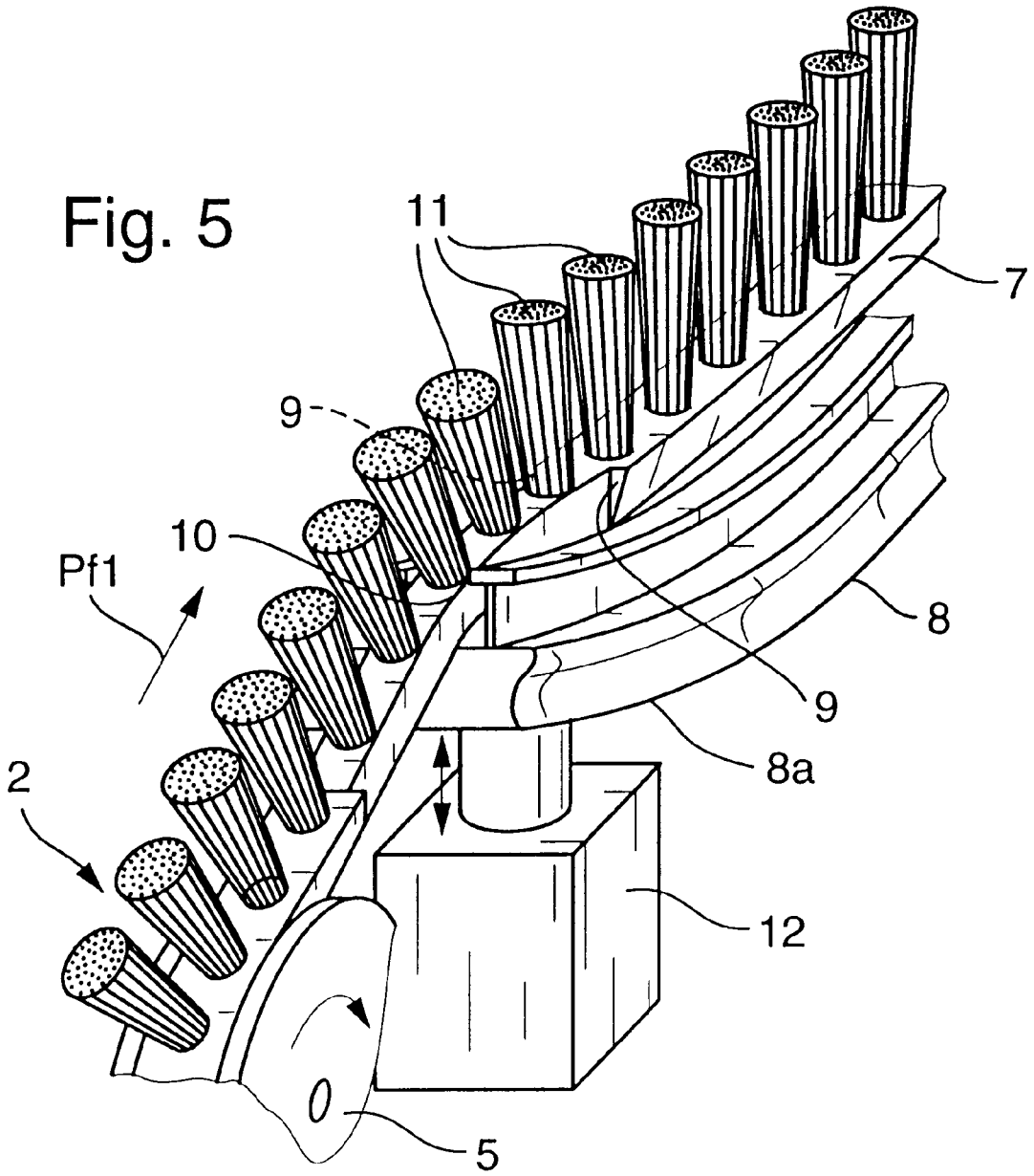
FIG. 5 is a diagrammatic representation of the operation of threading a carrier belt bearing a row of bristles, whereby its narrower area has already entered the start of the deflected guide, so that in the course of further feed the following, not relieved part of the belt then enters the guide and is thus threaded.

Therefore it is possible, according to FIG. 1 and according to FIG. 5 by way of example, to deflect the part 8*a* at the entrance end of the guide 8 as considered in the direction of feed, so that the carrier belt 7 has to run over it, but at the same time a tension in an opposite direction is imparted to the belt. When the area of the carrier belt 7 that is narrowed by the recesses 9 reaches the entrance area of this deflected part 8*a* of the guide 8, it can enter the guide from above due to the above-described dimensional relationships. As a result, the entire width of the following, not relieved area of the carrier belt 7 then enters the front of the guide, hence is automatically threaded, when one allows the carrier belt 7 to revolve in the direction of arrow Pf 1. As a consequence, by virtue of these geometrical relationships, the carrier belt with its bristles 11 can be automatically threaded into the guide, that is to say, a divided guide 8 is not required for fitting or later inserting a new carrier belt 7. The guide 8 can be correspondingly compact in design, and a plurality of such guides can also be arranged directly side by side, so that then several such carrier belts 7 can extend in parallel relation in these guides. By way of example, the guides depicted in FIGS. 5 and 6 can be flanked by corresponding guides in which corresponding carrier belts 7 can extend.

Mention was already made that the carrier belt 7 bears bristles 11. In the exemplary embodiment the cleaning device is a linear brush with a carrier belt 7 presenting the bristles 11. The width of the carrier belt 7 is greater than that of the array of bristles and the bristle-free edges of this carrier belt 7 are overlapped by the C-shaped profiled guide 8 in the use position according to FIG. 3 and also according to FIG. 6. During operation, very good retention of the carrier belt 7 is hence provided by the guide 8.

Figure 2:
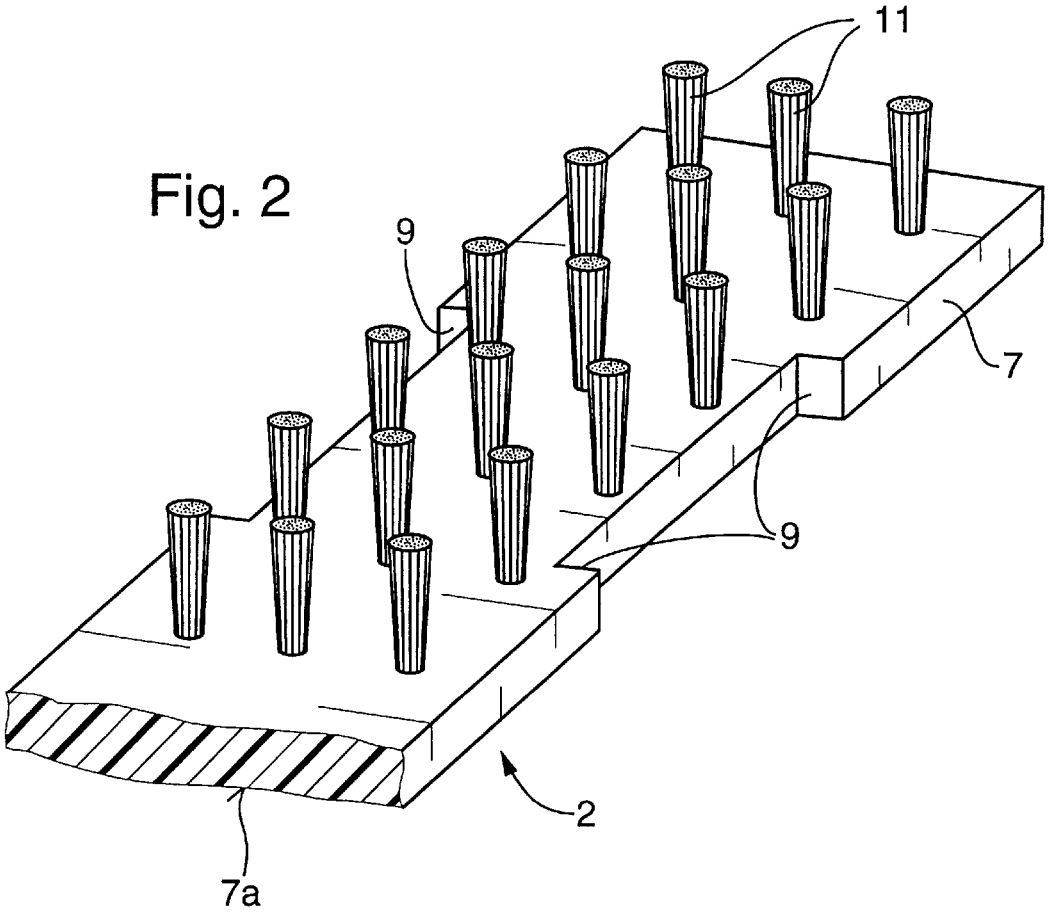
FIG. 2 is a diagrammatic representation of a portion of the cleaning device in the form of an actually circumferentially continuous carrier belt bearing bristles, showing the region of the belt which is narrowed by lateral recesses or reliefs.
Figure 3:
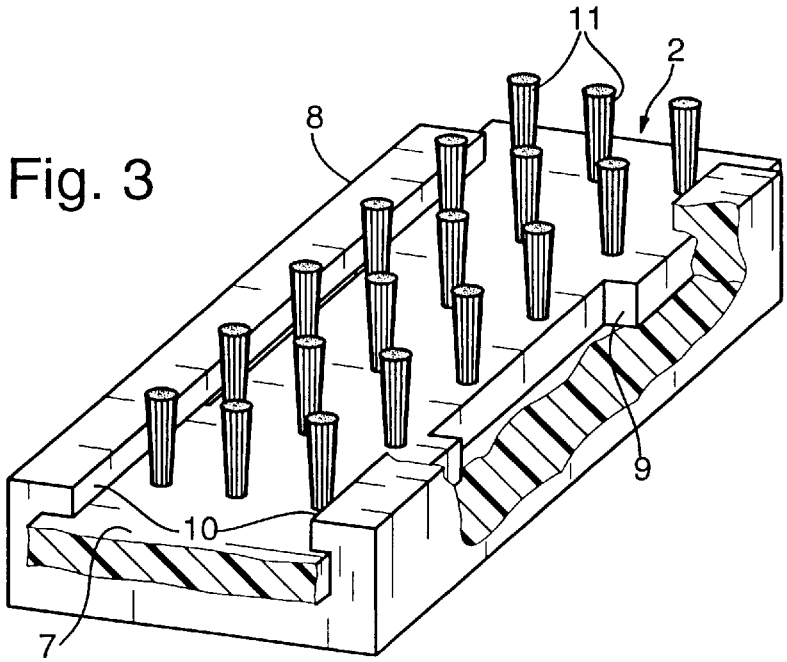
FIG. 3 is a portion of the guide and of the laterally relieved belt in the position of use.
Figure 4:
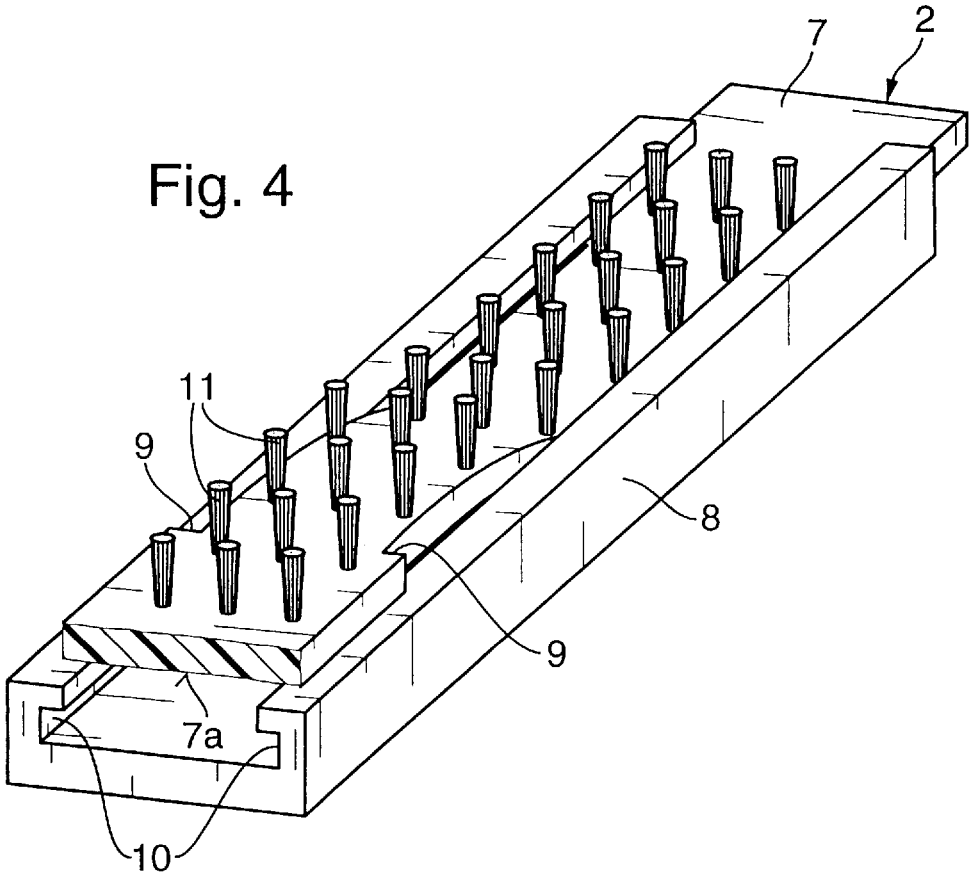
FIG. 4 is a representation corresponding generally to that of FIG. 3, in which a part of the belt is disposed in the guide and a further part of the belt is disposed outside the guide, this being enabled by the narrower area between these two zones, as the narrower area has a smaller dimension than the outer opening of the guide.
Figure 6:
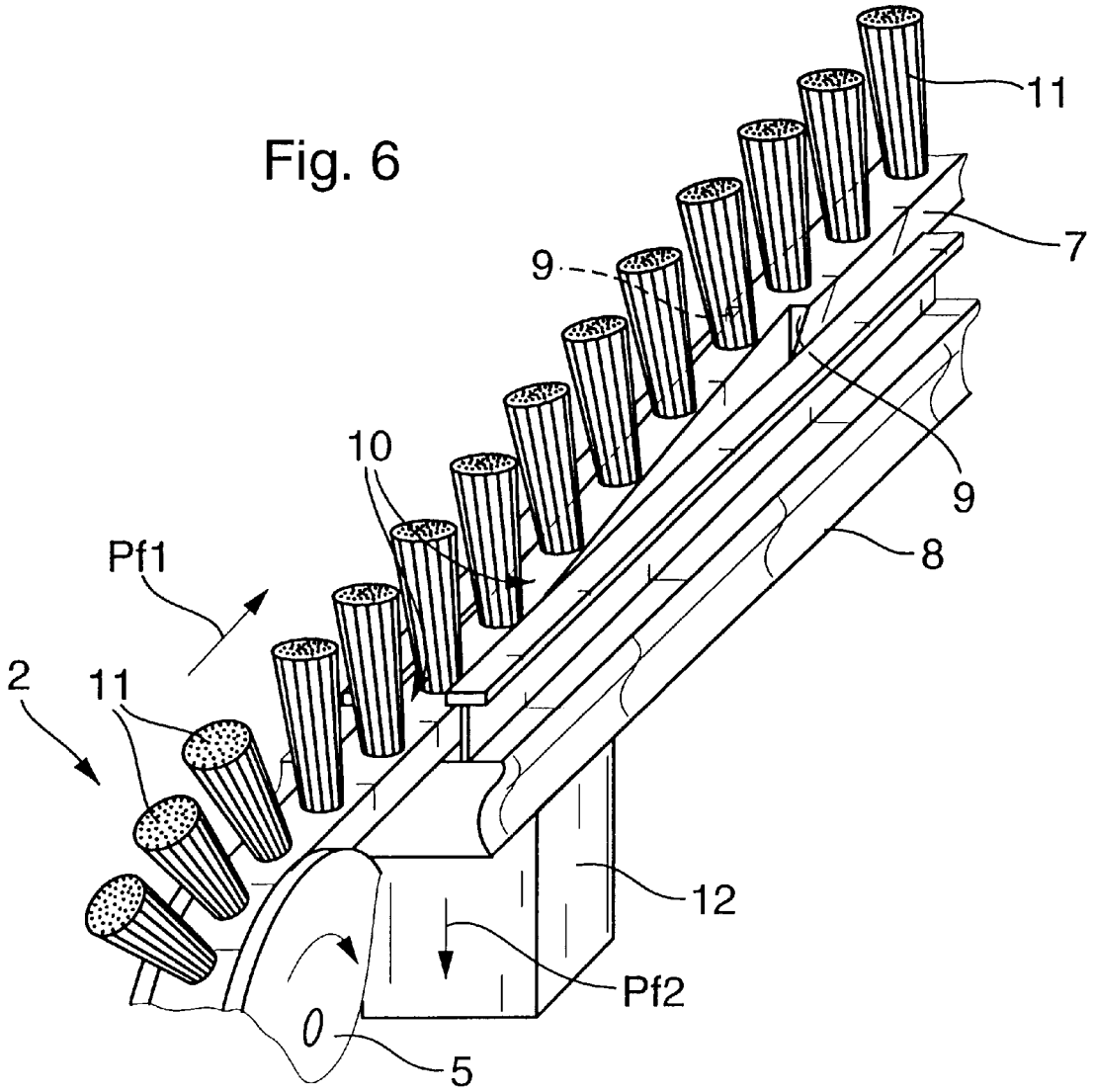
FIG. 6 is a representation corresponding to that of FIG. 5, in which the guide is moved inwards in a direction opposite that in FIG. 5, so that in the region of the relief the carrier belt can be moved out of the guide.

In the exemplary embodiment according to FIGS. 2 to 4, the carrier belt 7 is a flat belt, while in the exemplary embodiment according to FIGS. 5 and 6 it is a V-belt. In both instances it can additionally also take the form of a toothed belt.

The flat belt recommends itself if several rows of bristles are to be provided on its cleaning side, whereas the V-belt is particularly suitable if one row of bristles is arranged on the outside of this belt 7.

Particularly FIGS. 1 and 5 show that the deflectable or flexible part 8*a* of the guide 8 is disposed near the guide pulley 5 from which the carrier band or carrier belt 7 enters the guide 8. By means of such deflection, the tension acting in the opposite direction, as is useful for the threading operation according to FIG. 5, can be imparted to the belt 7 particularly well at that location.

FIGS. 1 and 5 each show in schematic form a working cylinder 12 acting upon the deflectable or flexible or swingable part 8*a* of the guide 8. However a deflection would also be possible with the aid of a lever that engages or is mounted in a suitable manner between upper strand and lower strand of the cleaning device 2.

FIG. 6 illustrates how the circumferentially continuous cleaning device 2 having the carrier belt 7 can also be unthreaded easily from the guide 8 by virtue of the recess or relief 9 on one side or two mutually opposed recesses or reliefs 9 at the longitudinal narrow sides of the carrier belt 7. For this purpose, the guide 8 or profiled guide is devised so as to be movable or swingable away from the cleaning portion, hence away from portion 4 in the exemplary embodiment, as is indicated by arrow Pf 2 in FIG. 6. By this means it is achieved that the part of the carrier band or carrier belt 7 following its narrower location between the mutually opposed recesses or reliefs 9 runs out of the guide 8 when the latter is in an inwardly moved condition. By means of the inward movement of the guide toward the opposite strand, the tension of the belt is utilized for the narrower area of the belt to depart from the slot 10 of the profiled guide, so that then the following part also runs outside the guide. As a result, after one revolution the carrier belt 7 no longer runs inside the guide 8, in the same way as conversely, during threading, practically less than one revolution suffices to move the carrier belt fully into the guide area.

Replacement of the cleaning devices having these carrier belts 7 can be simplified substantially by two extremely simple measures, namely the deflectability of one part 8*a* of the guide 8 and providing recesses or reliefs 9 at the longitudinal sides of the carrier belt 7. By means of the flattening at the lateral flanks, the brush of belt-like design can hence be threaded practically automatically when the guide is moved out and lifted near the guide pulley 5 so as to depart from the normal path of the belt 7. As soon as the narrow location in the region of the relief 9 reaches the lifted guide, the belt 7 springs into the working position, so that after one revolution the entire endless brush has reached its correct position. The guide can then be relieved again at part 8*a*, so as to assume its overall elongate position. Automatic unthreading of the carrier belt 7 is possible in an analogous fashion by the guide being drawn inwards in the region of its part 8*a*. As a result, the carrier belt 7 automatically springs out of the guide so as then to be easily withdrawable manually from the guide.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An apparatus (1) for cleaning surfaces, the apparatus comprising:

a looped cleaning device (2) having an upper portion (3) and a lower portion (4);

said cleaning device including a supple carrier belt (7) capable of withstanding tensile stresses and having an inner surface (7*a*) supported on at least two guide rollers (5, 6);

a press-on device (12) including an elongated guide (8) for the supple carrier belt (7), the press-on device (12) serving to press the lower portion (4) on to a surface to be cleaned during a feed movement of the supple carrier belt (7) through the guide (8), the guide (8) having a substantially C-shaped transverse cross-section accommodating an entire width of the supple carrier belt (7);

the supple carrier belt (7) being recessed in some regions of at least one of its longitudinal sides so as to be narrower in relation to a remainder of its longitudinal area, at least one guide part (8*a*) at an entrance of the guide (8), as considered in a feed direction of the lower portion (4), being deflectable outwardly from the feed direction and thereby being applied to the inner surface (7*a*) of the supple carrier belt (7), wherein a narrower slot (10) of the C-shaped guide has a width smaller than that of the carrier belt (7), but equal to or greater than that of the recessed regions of the carrier belt (7).

2. The apparatus as claimed in claim 1, wherein the cleaning device comprises a linear brush with the carrier belt (7) presenting bristles (11), wherein the width of the carrier belt (7) is greater than that of an array of bristles, and in a position of use at least one bristle-free edge of the carrier belt (7) is overlapped by the C-shaped guide (8).

3. The apparatus as claimed in claim 2, wherein the carrier belt (7) is overlapped by the C-shaped guide (8) at both longitudinal edges and is recessed on both sides.

4. The apparatus as claimed in claim 1, wherein the carrier belt (7) is selected from the group consisting of a flat belt, a V-belt and a toothed belt.

5. The apparatus as claimed in claim 1, wherein the deflectable part (8*a*) of the guide (8) is arranged near one of the guide rollers (5) from which the carrier belt (7) enters the guide (8).

6. The apparatus as claimed in claim 1, wherein the press-on device comprises a working cylinder (12) mounted between the upper portion and the lower portion is applied to the deflectable part (8*a*) of the guide (8).

7. The apparatus claimed in claim 1, wherein the guide (8) is movable away from the cleaning device, so that a portion of the carrier belt (7) that follows the narrower recess region of the belt runs out of the guide (8) when the guide is in an inwardly moved position.

* * * * *